US011441559B2

(12) United States Patent
Kato et al.

(10) Patent No.: US 11,441,559 B2
(45) Date of Patent: Sep. 13, 2022

(54) SCROLL FLUID MACHINE HAVING SEPARABLE MAIN BODY UNIT AND MOTOR UNIT

(71) Applicant: Hitachi Industrial Equipment Systems Co., Ltd., Tokyo (JP)

(72) Inventors: Fuminori Kato, Tokyo (JP); Shumpei Yamazaki, Tokyo (JP); Yoshiyuki Kanemoto, Tokyo (JP); Takanori Emi, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 228 days.

(21) Appl. No.: 15/755,827

(22) PCT Filed: Aug. 26, 2016

(86) PCT No.: PCT/JP2016/074895
§ 371 (c)(1),
(2) Date: Feb. 27, 2018

(87) PCT Pub. No.: WO2017/038653
PCT Pub. Date: Mar. 9, 2017

(65) Prior Publication Data

US 2018/0328358 A1 Nov. 15, 2018

(30) Foreign Application Priority Data

Aug. 28, 2015 (WO) ..... PCT/JP2015/074409

(51) Int. Cl.
*F04C 2/02* (2006.01)
*F04C 18/02* (2006.01)
*F04C 15/00* (2006.01)

(52) U.S. Cl.
CPC ..... *F04C 2/025* (2013.01); *F04C 15/0057* (2013.01); *F04C 18/02* (2013.01);
(Continued)

(58) Field of Classification Search
CPC .. F04C 15/0057; F04C 18/02; F04C 2230/60; F04C 2230/80; F04C 2240/30;
(Continued)

(56) References Cited

U.S. PATENT DOCUMENTS 4,207,710 A * 6/1980 Fournier ..... B23B 33/00 451/239
7,329,108 B2 * 2/2008 Tsuchiya ..... F01C 1/0215 418/101
(Continued)

FOREIGN PATENT DOCUMENTS

CN 101311536 A 11/2008
CN 203035549 U 7/2013
(Continued)

OTHER PUBLICATIONS

International Search Report (PCT/ISA/210) issued in PCT Application No. PCT/JP2016/074895 dated Dec. 6, 2016 with English-language translation (four (4) pages).
(Continued)

*Primary Examiner* — Dominick L Plakkoottam
*Assistant Examiner* — Paul W Thiede
(74) *Attorney, Agent, or Firm* — Crowell & Moring LLP

(57) ABSTRACT

A scroll fluid machine includes a main body and a motor unit. The main body unit configured to compress a fluid. The motor unit configured to drive the main body unit. The main body unit and the motor unit are connected via the eccentric portion. The main body casing and the motor cover are fastened with a fastening member. The motor unit includes a main bearing that is fixed to an inside of the motor cover by a flange. The main bearing is configured to support the shaft and is located between the flange and an end bracket on an opposite side of the main body unit with respect to the flange.

13 Claims, 5 Drawing Sheets

(52) U.S. Cl.
CPC ..... *F04C 18/0215* (2013.01); *F04C 2230/60* (2013.01); *F04C 2230/80* (2013.01); *F04C 2240/30* (2013.01); *F04C 2240/805* (2013.01)

(58) Field of Classification Search
CPC .. F04C 2240/805; F04C 2/025; F04C 29/045; F04C 29/005; F04C 18/0215; F04C 18/07; F04C 23/008; F04C 2/07; F04C 29/0071; F16D 3/04; F01C 17/066; F01C 21/10
USPC ..... 418/55.1–55.6, 57, 60; 417/410.1; 464/102
See application file for complete search history.

(56) References Cited

U.S. PATENT DOCUMENTS

| | | | | |
|---|---|---|---|---|
| 9,279,423 | B2 * | 3/2016 | Yamazaki | F04C 2/07 |
| 2005/0220648 | A1 * | 10/2005 | Sato | F01C 21/02 418/55.3 |
| 2007/0077159 | A1 * | 4/2007 | Tsuchiya | F04C 29/045 418/55.1 |
| 2008/0240957 | A1 | 10/2008 | Yanagisawa | |
| 2009/0110580 | A1 * | 4/2009 | Suefuji | F01C 17/063 418/55.2 |
| 2009/0185927 | A1 * | 7/2009 | Duppert | F04C 18/0215 418/55.1 |
| 2010/0209278 | A1 * | 8/2010 | Tarao | F01C 21/02 418/55.3 |
| 2011/0300012 | A1 * | 12/2011 | Fujioka | F01C 1/0215 418/55.1 |
| 2013/0028730 | A1 * | 1/2013 | Hirata | F04B 39/121 415/229 |
| 2013/0294951 | A1 | 11/2013 | Ishikawa et al. | |
| 2014/0134034 | A1 * | 5/2014 | Nakamura | F01C 21/008 418/55.3 |
| 2015/0093275 | A1 * | 4/2015 | Yamazaki | F04C 29/005 418/55.3 |
| 2015/0093276 | A1 * | 4/2015 | Kanemoto | F04C 18/0215 418/55.5 |
| 2015/0247500 | A1 * | 9/2015 | Duppert | F01C 17/066 418/55.3 |

FOREIGN PATENT DOCUMENTS

| | | | |
|---|---|---|---|
| CN | 204003385 | U | 12/2014 |
| EP | 2 669 520 | A1 | 12/2013 |
| JP | 6-74164 | A | 3/1994 |
| JP | 2001-304142 | A | 10/2001 |
| JP | 2002-138974 | A | 5/2002 |
| JP | 2003-65271 | A | 3/2003 |
| JP | 2004-197568 | A | 7/2004 |
| JP | 2006-29238 | A | 2/2006 |
| JP | 2006-46078 | A | 2/2006 |
| JP | 2006-194092 | A | 7/2006 |
| JP | 2006-250145 | A | 9/2006 |
| JP | 2006-274976 | A | 10/2006 |
| JP | 2007-24017 | A | 2/2007 |
| JP | 2007-100514 | A | 4/2007 |
| JP | 2009-281279 | A | 12/2009 |
| JP | 2011-69311 | A | 4/2011 |
| JP | 2011-252434 | A | 12/2011 |
| JP | 2011-252448 | A | 12/2011 |
| JP | 2012-158988 | A | 8/2012 |
| JP | 2014-190245 | A | 10/2014 |
| JP | 2014-222066 | A | 11/2014 |
| JP | 2015-68171 | A | 4/2015 |
| WO | WO 2008/120791 | A1 | 10/2008 |

OTHER PUBLICATIONS

Japanese-language Written Opinion (PCT/ISA/237) issued in PCT/JP2016/074895 dated Dec. 6, 2016 (four (4) pages).
International Search Report (PCT/ISA/210) issued in PCT Application No. PCT/JP2015/074409 dated Nov. 10, 2015 with English-language translation (four (4) pages).
Japanese-language Written Opinion (PCT/ISA/237) issued in PCT/JP2015/074409 dated Nov. 10, 2015 (five (5) pages).
Chinese-language Office Action issued in counterpart Chinese Application No. 201680049924.8 dated Sep. 29, 2018 (eight (8) pages).
Extended European Search Report issued in counterpart European Application No. 16 841 685.7 dated May 16, 2019 (five (5) pages).
Chinese-language Office Action issued in counterpart Chinese Application No. 201680049924.8 dated May 15, 2019 (nine (9) pages).
Extended European Search Report issued in counterpart European Application No. 16841685.7 dated Feb. 13, 2019 (seven pages).
Chinese-language Office Action issued in Chinese Application No. 201680049924.8 dated Feb. 3, 2020 (nine (9) pages).
Extended European Search Report issued in European Application No. 20175317.5 dated Jun. 9, 2020 (eight (8) pages).
Hindi-language Office Action issued in Indian Application No. 201817007581 dated Jun. 4, 2020 with English translation (six (6) pages).
Japanese-language Office Action issued in Japanese Application No. 2019-123385 dated Jun. 4, 2020 with English translation (18 pages).
Chinese-language Office Action issued in Chinese Application No. 201680049924.8 dated Sep. 3, 2020 with English translation (23 pages).
Chinese-language Office Action issued in Chinese Application No. 202110398904.4 dated Jul. 11, 2022 with partial English translation (nine (9) pages).

* cited by examiner

FIG. 1
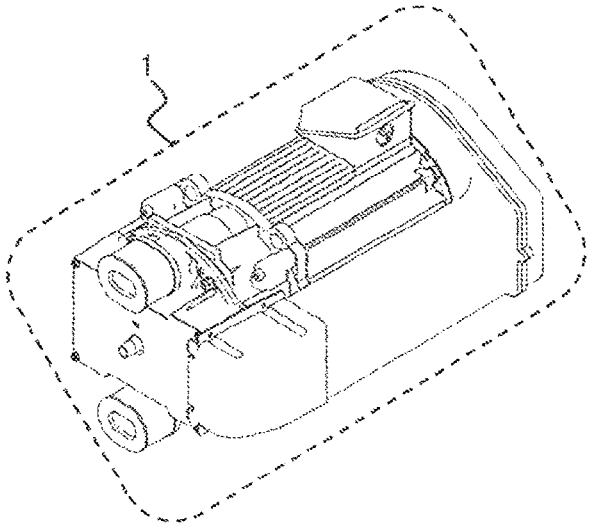
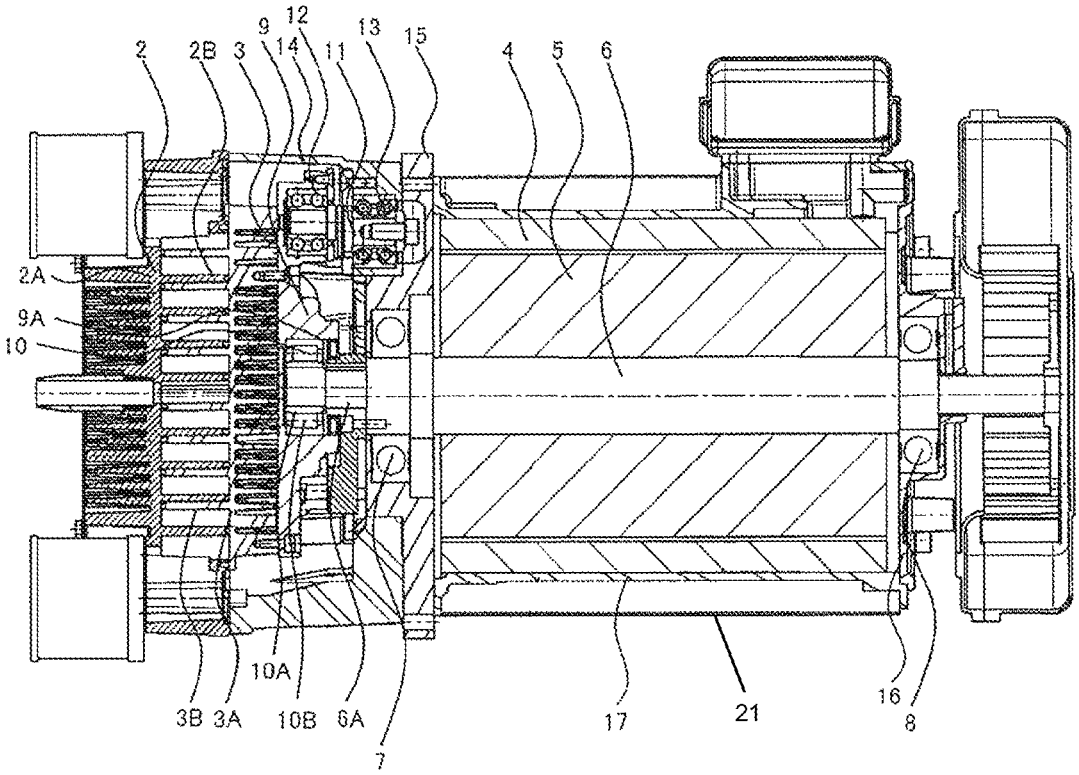
FIG. 2

SCROLL FLUID MACHINE HAVING SEPARABLE MAIN BODY UNIT AND MOTOR UNIT

TECHNICAL FIELD

The present invention relates to a scroll-type fluid machine and a maintenance method for the scroll-type fluid machine.

BACKGROUND ART

There are Patent Literatures 1 and 2 as the background art of the present invention. Patent Literature 1 describes "a rotating machine, in which an output side of a motor-type driving unit having a horizontal axis line is fixed to a first side of an attached plate in a support bracket in which the attached plate is provided to stand on a base plate, and an input side of a main body of a driven rotating machine is removably mounted on a second side of the attached plate, so that an output shaft of the motor-type driving unit can be connected to an input shaft of the main body of the driven rotating machine".

Patent Literature 2 describes "a scroll-type fluid machine, comprising: a casing; a fixed scroll provided in the casing and including a spiral wrapping section provided to stand; a revolving scroll, in which a spiral wrapping section that overlaps with the wrapping section of the fixed scroll is provided stand on a surface of a panel, the revolving scroll revolved while forming a plurality of compression chambers in combination with the fixed scroll; a drive shaft that is rotatably provided in the casing and drives the revolving scroll; and a plurality of auxiliary crank mechanisms in a circumferential direction of the revolving scroll provided to revolve the revolving scroll while preventing autorotation of the revolving scroll, wherein the auxiliary crank mechanism includes a revolving-side bearing section provided on the revolving scroll side, a fixing-side bearing section provided on a fixing side, and an auxiliary crank shaft connected to the revolving-side bearing section and the fixing-side bearing section, at least one of the revolving-side bearing section and the fixing-side bearing section is housed in a boss piece, and the boss piece is connected to the revolving scroll or the fixing side via a support column in an axial direction".

CITATION LIST

Patent Literature

PATENT LITERATURE 1: JP-A-2006-29238
PATENT LITERATURE 2: JP-A-2011-252448

SUMMARY OF INVENTION

Technical Problem

In the scroll-type fluid machine (rotating machine) of Patent Literature 1, an eccentric portion (an eccentric tube 14) at a distal end of a shaft (an output shaft 10) is kept attached to a main body unit (a driven rotating machine main body) side when, for example, a motor-type driving unit 7 is removed. For this reason, operation check cannot be performed only with a motor.

In the scroll-type fluid machine of Patent Literature 2, operation check can be performed only with a motor unit (a motor (driving source) 15), for example, after the motor unit is removed; however, since a shaft (a main shaft 15B) and a main shaft section 9 are separate units and connected by using a fastening member, the number of parts is large and labor is required at the time of disassembly. In addition, since the shaft and the main shaft section 9 are separate units, misalignment easily occurs. When misalignment occurs, a load applied to a main bearing is increased, which causes reduction in bearing life.

For example, there is a revolving bearing at a distal end of the eccentric portion of the shaft. The revolving bearing requires maintenance, such as supplying a lubricant, like grease. Since the eccentric portion is in a state of being attached to a compressor unit in both Patent Literature 1 and Patent Literature 2, the eccentric portion (the eccentric tube 14) needs to be further removed after the motor-type driving unit 7 is removed in order to oil the revolving bearing. For this reason, in the configuration of Patent Literature 1, grease cannot be supplied to the revolving bearing only by removing the motor-type driving unit 7 from the main body unit (the driven rotating machine main body). Accordingly, maintenance, such as visual check of grease of the revolving bearing and supplying grease, cannot be performed easily.

In view of the above problems, an object of the present invention is to provide a scroll-type fluid machine and a maintenance method for the scroll-type fluid machine, in which separation, assembly, and maintenance of the compressor main body unit and the motor unit can be performed easily.

Solution to Problem

To solve the above problems, according to the present invention, there is provided a scroll-type fluid machine, including: a main body unit configured to compress a fluid; and a motor unit configured to drive the main body unit, wherein the main body unit includes a fixed scroll, a revolving scroll, a main body casing, and an autorotation preventing mechanism configured to be held by the revolving scroll and the main body casing and prevent autorotation of the revolving scroll, the motor unit includes a rotor, a stator configured to rotate the rotor, a shaft configured to rotate integrally with the rotor, a motor cover configured to house the rotor and the stator, and a main bearing configured to be fixed in the inside by the motor cover and support the shaft, an eccentric portion is included at a distal end of the shaft, the main body unit and the motor unit are connected via the eccentric portion, and the main body casing and the motor cover are fastened with a fastening member.

Further, according to another aspect of the present invention, there is provided a maintenance method for a scroll-type fluid machine, including: separating a main body unit configured to compress a fluid in a compression chamber between a fixed scroll and a revolving scroll and a motor unit configured to drive the main body unit by rotation of a shaft without disassembling the main body unit by removing an eccentric portion formed at a distal end of the shaft from the main body unit after removing a fastening member configured to fasten a main body casing attached to the fixed scroll and a motor cover provided on an outer side in a radial direction of the shaft.

Advantageous Effects of Invention

According to the present invention, a scroll-type fluid machine and a maintenance method for the scroll-type fluid machine, in which separation, assembly, and maintenance of a compressor unit and a motor unit can be performed easily.

BRIEF DESCRIPTION OF DRAWINGS

FIG. 1 is an entire diagram of a scroll-type fluid machine according to a first embodiment of the present invention.

FIG. 2 is a cross-sectional view in a side surface direction of the scroll-type fluid machine according to the first embodiment of the present invention.

DESCRIPTION OF EMBODIMENTS

First Embodiment

Figure 3A:
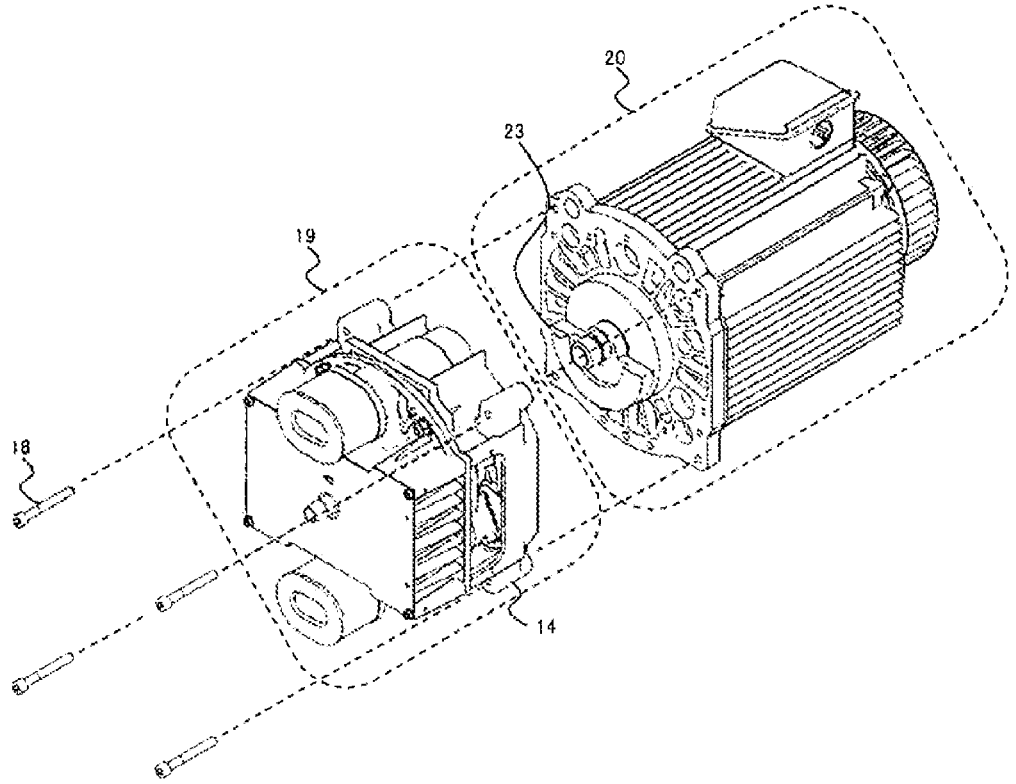
FIG. 3A is a perspective view showing a state in which a main body unit and a motor unit are separated in the first embodiment of the present invention.
Figure 3B:
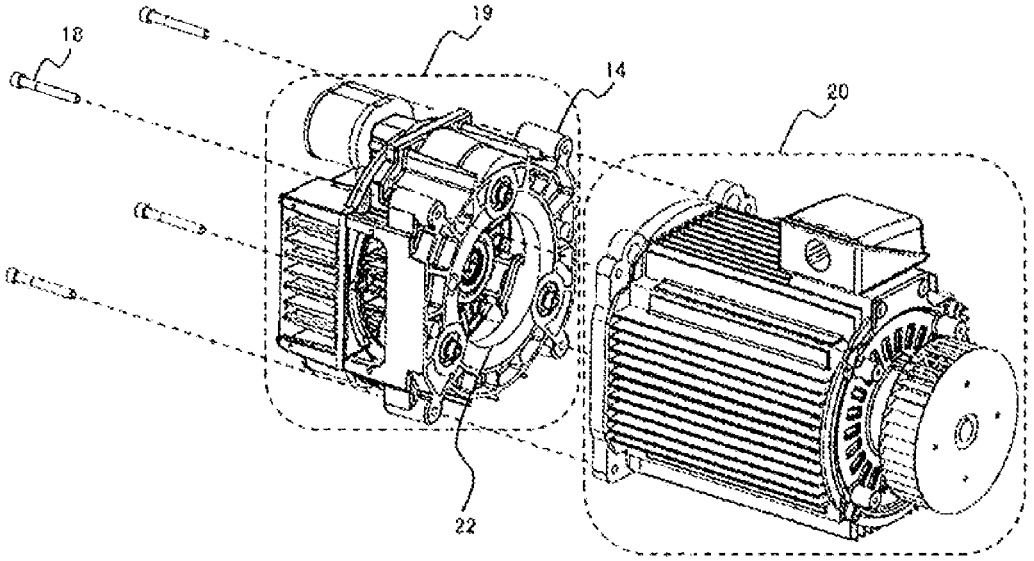
FIG. 3B is a perspective view showing a state in which the main body unit and the motor unit are separated in the first embodiment of the present invention.

Hereinafter, detailed description will be made on a first embodiment of the present invention based on the accompanying diagram. FIG. 1 shows an outline of a scroll-type fluid machine 1 in the present invention. FIG. 2 shows a cross-sectional view of the scroll-type fluid machine 1 of FIG. 1 viewed from a side surface. FIGS. 3A and 3B show an example of a separated state of a main body unit 19 and a motor unit 20.

The scroll-type fluid machine 1 in the present embodiment shown in FIG. 1 may be a scroll-type compressor that compresses specific gas, such as air and nitrogen, or refrigerant, or a scroll-type vacuum pump.

As shown in FIGS. 3A and 3B, the scroll-type fluid machine 1 is configured with the main body unit 19 that compresses a fluid and the motor unit 20 that drives the main body unit 19. As shown in FIG. 2, an internal structure of the main body unit 19 is configured with a fixed scroll 2, a revolving scroll 3 arranged to face the fixed scroll 2, and a main body casing 14 that covers the revolving scroll 3 from an outer side in a radial direction. In the fixed scroll 2 and the revolving scroll 3, spiral wrapping sections 2B and 3B are formed on surfaces of panels 2A and 3A, respectively. The wrapping sections 2B and 3B of the fixed scroll 2 and the revolving scroll 3 overlap each other to constitute a compression chamber. The main body casing 14 has a tubular shape, and has both ends opened. The fixed scroll 2 is attached to an opening section on a one end side of the main body casing 14, and the motor unit 20 is attached to an opening section 22 on the other end side. The revolving scroll 3 is driven by the motor unit 20, and performs a revolving motion. The main body unit 19 compresses and discharges a fluid when the revolving motion of the revolving scroll 3 continuously contracts the compression chamber formed between the wrapping section 2B of the fixed scroll 2 and the wrapping section 3B of the revolving scroll 3. The present embodiment exemplifies the scroll-type fluid machine 1 that has only one pair of the fixed scroll 2 and the revolving scroll 3; however, the scroll-type fluid machine 1 may include the revolving scroll 3 that has the wrapping sections 3B on both sides of the panel 3A and the fixed scroll 2 on both sides of the revolving scroll 3.

The revolving scroll 3 includes a boss section 9A that houses a shaft 6 of the motor unit 20 on a back surface side (an opposite side of the surface on which the wrapping section 3B is formed) of the panel 3A. The boss section 9A may be directly formed on the back surface of the panel 3A of the revolving scroll 3, or may be formed on a back surface (a surface on an opposite side of the revolving scroll 3) of a boss plate 9 which is provided at a position away from the back surface of the panel 3A as shown in FIG. 2.

The boss section 9A provided on the back surface side of the revolving scroll 3 is provided with a revolving bearing 10 that supports a centrifugal force generated by a revolving motion of the revolving scroll 3 and a gas load that is generated by compressing air.

A plurality of autorotation preventing mechanisms for preventing autorotation of the revolving scroll 3 are provided between the main body casing 14 and the revolving scroll 3. The autorotation preventing mechanism prevents autorotation of the revolving scroll 3 and supports a gas load in an axial direction applied from the revolving scroll 3. The autorotation preventing mechanism has two eccentric shafts which are formed integrally in an axial direction, is held in a radial direction by a casing-side auxiliary crank bearing 13, and is configured with an auxiliary crank shaft 11 that prevents autorotation of the revolving scroll 3 by performing a rotation motion by following the revolving scroll 3, a revolving-side auxiliary crank bearing 12 that supports the auxiliary crank shaft 11 and is housed in the revolving scroll 3, and a casing-side auxiliary crank bearing 13 housed in the main body casing 14. The autorotation prevention mechanism may be configured by using, for example, a ball coupling mechanism, an Oldham coupling, or the like, in place of the auxiliary crank mechanism described so far.

The auxiliary crank shaft 11 is held by the main body casing 14 and the revolving scroll 3 with the revolving-side auxiliary crank bearing 12 and the casing-side auxiliary crank bearing 13 provided between them. For example, the auxiliary crank shaft 11 is fixed to the main body casing 14 with a bolt, and is fixed to the revolving scroll 3 by interference fitting with the revolving-side auxiliary crank bearing 12 provided between them. The auxiliary crank shaft 11 is loosely fitted to the revolving-side auxiliary crank bearing 12 (the casing-side auxiliary crank bearing 13), and may be fixed to the revolving scroll 3 (the main body casing 14) with a keep plate.

That is, the main body casing 14 and the revolving scroll 3 face each other in an axial direction (a longitudinal direction of the shaft 6), and are held (fixed) in the axial direction with the autorotation preventing mechanism provided between them.

For this reason, when the shaft 6 is pulled out from the main body unit 19 in order to separate the main body unit 19 and the motor unit 20, the revolving scroll 3 is not separated from the main body casing 14. In this manner, the motor unit 20 can be separated without disassembling the main body unit 19.

As shown in FIG. 2, the motor unit 20 includes a stator 4 and a rotor 5 that generate power, and the shaft 6 that is integrated with the rotor 5 by press fitting and the like and transmits power to the outside. When the stator 4 provides a turning force to the rotor 5, the shaft 6 integral with the rotor 5 rotates. The shaft 6 has an eccentric portion 6A. The eccentric portion 6A is housed in the boss section 9A provided on a back surface of the revolving scroll 3 in a manner removable only by being pulled in an axial direction when the main body unit 19 and the motor unit 20 are assembled (for example, the eccentric portion 6A is attached to the boss section 9A by loose fitting), and is removably attached to the main body unit. In this manner, the main body unit 19 and the motor unit 20 are connected with the eccentric portion 6A provided between them. The eccentric portion 6A of the shaft 6 performs an eccentric motion due to a rotation motion of the shaft 6. For this reason, rotation of the shaft 6 causes the revolving scroll 3 connected to the eccentric portion 6A to perform a revolving motion. The motor unit 20 also includes a motor cover 21 that contains the stator 4 and the rotor 5. The motor cover 21 is configured with a motor casing 17 having a tubular shape that covers the stator 4, the rotor 5, and the shaft 6 from an outer side in a radial direction, a flange 15 provided in an opening section on the main body unit 19 side of the motor casing 17, and an end bracket 16 provided in an opening section on an opposite side of the main body unit 19.

The motor casing 17 is fixed to the stator 4, and houses the rotor 5 and the shaft 6. The shaft 6 is supported by a main bearing 7 and an anti-load bearing 8. The main bearing 7 and the anti-load bearing 8 are arranged to be concentric, and the shaft 6 is prohibited from being inclined to an axis line of the main bearing 7 and the anti-load bearing 8. In this manner, vibration generated by inclination of the shaft 6 is restrained when the scroll-type fluid machine 1 is operated.

In the present embodiment, the main bearing 7 is arranged in the motor cover 21, that is, between the flange 15 and the end bracket 16 (on an opposite side of the main body unit 19 with respect to the flange 15). The main bearing 7 is fixed in the motor cover 21 by the flange 15. The flange 15 is fastened to the motor casing 17. The flange 15 may be formed integrally with the motor casing 17. The main body casing 14 and the motor cover 21 may be fastened in a manner that the flange 15 is sandwiched between the main body casing 14 and the motor casing 17.

In the present embodiment, the main bearing 7 and at least part of the autorotation preventing mechanisms are arranged at positions in an axial direction (a longitudinal direction of the shaft 6) that overlap each other when viewed from a radial direction. That is, an end surface on the main body unit 19 side of the main bearing 7 is arranged closer to the main body unit 19 side than an end surface on the motor unit 20 side of the autorotation preventing mechanisms (the casing-side auxiliary crank bearing 13).

In particular, when the main body unit 19 and the motor unit 20 are formed as separate units and have a separable structure like in the present embodiment, size is easily increased in an axial direction. On the other hand, there is space on an inner side in a radial direction of the autorotation preventing mechanism of the main body unit 19. The main bearing 7 is arranged in the space. In this manner, a dimension in an axial direction of the shaft 6 can be reduced, and a dimension in an axial direction of the entire scroll-type fluid machine 1 can be reduced.

For the revolving scroll 3 to perform a stable revolving motion at a proper position, the main bearing 7 and the autorotation preventing mechanism need to be connected (fixed). At this time, if positions in an axial direction of the main bearing 7 and the autorotation preventing mechanism are apart from each other, a large load (moment) is applied to a member that connects the main bearing 7 and the autorotation preventing mechanism during operation of the scroll-type fluid machine 1. For this reason, a reinforcing member, such as a rib, needs to be made large, and reduction in size and weight cannot be achieved. On the other hand, when positions in an axial direction of the main bearing 7 and at least part of the autorotation preventing mechanisms overlap each other like in the present embodiment, reduction in size and weight of a member that connects the main bearing 7 and the autorotation preventing mechanism can be reduced, and reduction in size and weight of the entire scroll-type fluid machine 1 can be achieved.

If the main bearing 7 is provided on an outer side of the motor cover 21 in a state where an outer ring of the main bearing 7 is exposed, stability of the main bearing 7 needs to be secured when the main body unit 19 and the motor unit 20 are assembled so that the motor unit 20 is operated. Vibration during operation also needs to be restrained. For this reason, the main bearing 7 needs to be fitted to the main body unit 19. On the other hand, in the present embodiment, the main bearing 7 is fixed to the inside of the motor cover 21 by the flange 15. By the above configuration, the main bearing 7 does not need to be attached to or removed from the main body unit 19 when the main body unit 19 and the motor unit 20 are connected and separated. When the main body unit 19 and the motor unit 20 are separated, the main bearing 7 can be prevented from moving in an axial direction of the shaft 6 and becoming unstable. For this reason, by providing the main bearing 7 in the motor cover 21, the main body unit 19 and the motor unit 20 can be easily connected and separated. When the shaft 6 is pulled out from the main body unit 19 in order to separate the main body unit 19 and the motor unit 20, the main bearing 7 is never separated from the motor unit 20. In this manner, the motor unit 20 can be separated from the main body unit 19 without disassembling the motor unit 20. That is, assembly of the scroll-type fluid machine 1 and replacing work of the main body unit 19 and the motor unit 20 are facilitated. In addition, operation check using only the motor unit 20 and maintenance, such as, replacement of a part (including replacement of a motor that accompanies change of capacity of the motor) and supplying grease, become possible.

At this time, the flange 15 has a step shape, in which an inner side in a radial direction protrudes to the main body unit 19 side relative to an outer side in the radial direction. The main bearing 7 is fixed to an inner side in a radial direction of a surface on an opposite side of the main body unit 19 of the flange 15 (a section protruding to the main body unit 19 side). On the other hand, a fastening bearing surface 24 with respect to the main body unit 19 is on an outer side in a radial direction of the flange 15 (a section not protruding to the main body unit 19 side). That is, a position in an axial direction of at least part of the main bearing 7 is closer to a distal end of the eccentric portion 6A than a position in an axial direction of the fastening bearing surface 24 with respect to the main body unit 20 formed on the flange 15. In this manner, there can be achieved a configuration in which the main bearing 7 is fixed in the motor cover 21 by the flange 15, and a position in an axial direction of at least part of the main bearing 7 overlaps with that of the autorotation preventing mechanism.

Figure 7A:
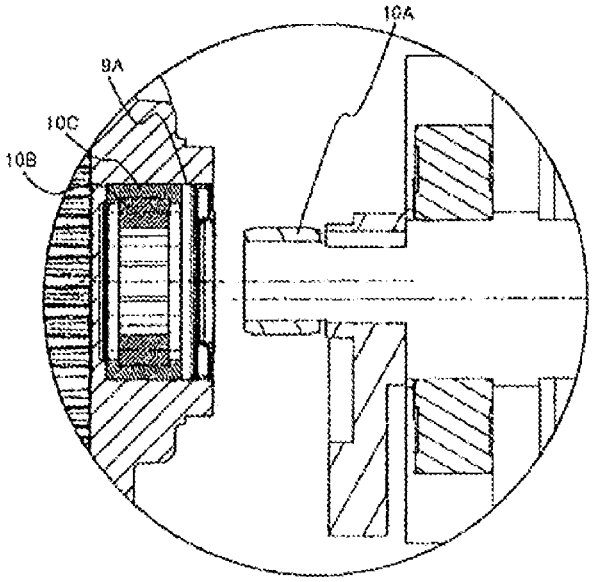
FIG. 7A is an enlarged view of a revolving bearing in the first embodiment of the present invention.

FIG. 7A shows an enlarged view of the revolving bearing 10 according to the present embodiment. The eccentric portion 6A of the shaft 6 is supported by the revolving bearing 10 with respect to the revolving scroll 3. Power of the shaft 6 is transmitted to the revolving scroll 3 through the revolving bearing 10. The revolving bearing 10 is configured with a revolving bearing inner ring 10A having an annular shape fixed to the shaft 6 by press fitting and the like, a plurality of revolving bearing rollers 10B provided in the boss section 9A of the main body unit 19, and a revolving bearing outer ring 10C having an annular shape fixed to the boss section 9A by press fitting and the like.

The revolving bearing roller 10B is rotatably held between the revolving bearing inner ring 10A and the revolving bearing outer ring 10C. At the time of maintenance, a lubricant, such as grease, needs to be supplied to a plurality of the revolving bearing rollers 10B separated to the main body unit 19 side (or the motor unit side). In the present embodiment, the revolving bearing inner ring 10A is formed integrally with the eccentric portion 6A of the shaft 6 so as to be a constituent of the motor unit 20. The revolving bearing outer ring 10C is formed integrally with the boss section 9A so as to be a constituent of the main body unit 19. In this manner, the main body unit 19 and the motor unit 20 can be easily separated at the revolving bearing inner ring 10A and the revolving bearing roller 10B, and reassembly can also be performed easily. By forming the shaft 6 and the eccentric portion 6A integrally, the number of parts can be reduced, and labor of assembly and disassembly can be reduced. In addition, since the revolving bearing roller 10B is exposed at the time of disassembly, maintenance, such as supplying grease to the revolving bearing roller 10B, replacement of a part, and visual check, can be performed easily.

Figure 7B:
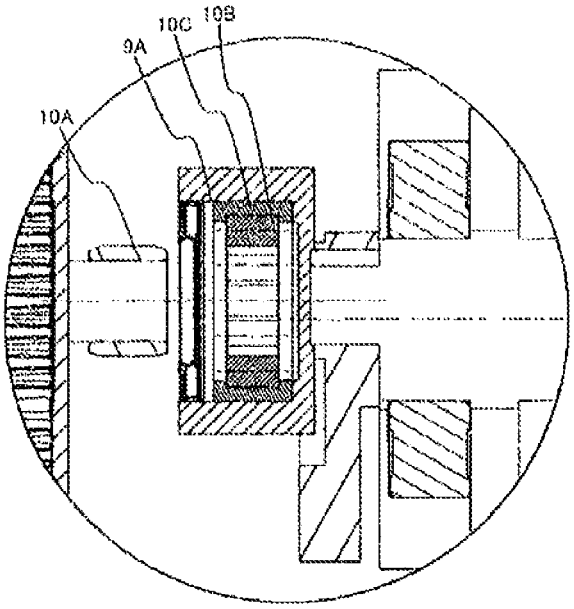
FIG. 7B is an enlarged view of the revolving bearing in a variation of the first embodiment of the present invention.

In the present embodiment, the revolving bearing roller 10B is a constituent on the main body unit 19 side; however, as long as the structure is such that the revolving bearing roller 10B is exposed when the main body unit 19 and the motor unit 20 are separated, for example, like a variation shown in FIG. 7B, the revolving bearing inner ring 10A may be a constituent on the main body unit 19 side and the revolving bearing roller 10B and the revolving bearing outer ring 10C may be constituents on the motor unit 20 side. The boss section 9A of FIG. 7B may be integral with a balance weight 23 and a constituent on the motor unit 20 side.

As shown in FIGS. 3A and 3B, in the present embodiment, a fastening member that fastens the motor cover 21 and the main body casing 14 is removed and the main body unit 19 and the motor unit 20 are separated in order to perform maintenance. At this time, the eccentric portion 6A of the shaft 6 is removed from the main body unit 19 (the boss section 9A). At this time, the revolving bearing inner ring 10A is removed integrally with the shaft 6. On the other hand, the revolving bearing outer ring 10C is on the main body unit 19 side even after the motor unit 20 is removed. The eccentric portion 6A of the shaft 6 is attached to the boss section 9A (the revolving bearing inner ring 10A is attached to the revolving bearing roller 10B) by loose fitting. For this reason, only by removing the fastening bolt 18 and pulling out the main body unit 19 in an axial direction, the main body unit 19 and the motor unit 20 can be separated. In this manner, each unit can be easily replaced with a new unit, and an output of the motor unit 20 can be easily changed. Since the motor unit 20 includes the main bearing 7, operation and performance check can be performed only with the motor unit 20 after each unit is separated. In the main body unit 19, the revolving bearing 10 (the revolving bearing roller 10B) and the casing-side auxiliary crank bearing 13 are exposed on a back surface side, so that replacement of parts and maintenance, such as visual check and supplying a lubricant, like grease, can be performed easily.

After the maintenance is performed, the eccentric portion 6A of the shaft 6 is inserted in the boss section 9A of the main body unit 19. By fastening the motor cover 21 and the main body casing 14 with a fastening member (for example, by inserting the fastening bolt 18 in a bolt insertion hole provided on the motor cover 21 and the main body casing 14), the motor unit 20 is assembled with the main body unit 19, and the scroll-type fluid machine 1 is assembled again.

By the above separation and assembly structure, the scroll-type fluid machine 1 can be easily assembled in an operable state after the main body unit 19 and the motor unit 20 are assembled separately.

Figure 4:
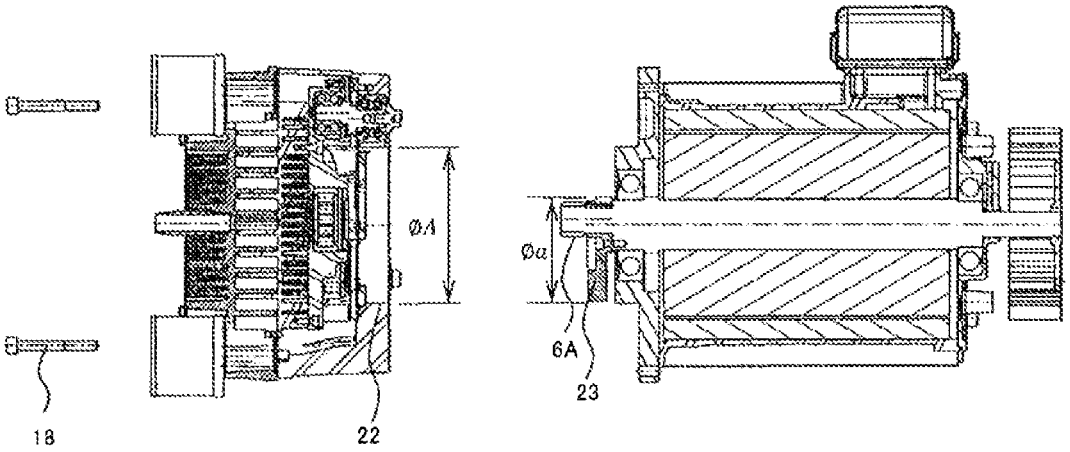
FIG. 4 is a cross-sectional view in a side surface direction showing a state in which the main body unit and the motor unit are separated in the first embodiment of the present invention.

Description will be made on a separation structure of the main body unit 19 and the motor unit 20 by using FIGS. 3A, 3B, and 4. FIG. 4 is a cross-sectional view in a side surface direction in a separated state.

At the time of maintenance of the main body unit 19, maintenance of the revolving bearing 10 needs to be performed by supplying a lubricant, such as grease. In the prior art described in Patent Literature 1, the main body unit 19 and the motor unit 20 are separably connected in series, although the eccentric portion 6A of the shaft 6 is kept attached to the main body unit 19. To perform the maintenance of the revolving bearing 10, work of disassembling the eccentric portion 6A of the shaft 6 and also removing the eccentric portion of the shaft 6 is required after the main body unit 19 and the motor unit 20 are separated. For this reason, work processes other than separation of the main body unit 19 and the motor unit 20 are required, and the maintenance cannot be performed easily.

On the other hand, in the present embodiment, the eccentric portion 6A of the shaft 6 is formed integrally with the shaft 6, and is a constituent on the motor unit 20 side. Accordingly, the eccentric portion 6A of the shaft 6 is removed from the main body unit 19 when the main body unit 19 and the motor unit 20 are separated. For this reason, visual check of grease and supply of grease to the revolving bearing 10 of the main body unit 19 can be performed without disassembling the main body unit 19, and the maintenance is facilitated. The eccentric portion 6A of the shaft 6 is formed integrally with the shaft 6 and is configured to be removed to the motor unit side integrally with the shaft 6 when the main body unit 19 and the motor unit 20 are separated. As long as the above configuration is used, for example, the eccentric portion 6A and the shaft 6 may be configured to be fastened with a bolt, and the shaft 6 and the eccentric portion 6A can be separated by removing the bolt.

An area of the opening section 22 on the motor unit 20 side of the main body casing 14 is larger than a projection area of the motor unit 20 (an area of a shadow created when parallel light is emitted to a section protruding to the main body unit 19 side from the flange 15 from an axial direction of the shaft 6) between a distal end of the eccentric portion 6A viewed from an axial direction of the shaft 6 and the flange 15 (a section protruding to the main body unit 19 side from the flange 15). That is, a diameter $\phi$A of the opening section 22 of the main body casing 14 is made larger than a maximum diameter of the motor unit 20 between a distal end of the eccentric portion 6A and the flange 15 (a section protruding to the main body unit 19 side from the flange 15). In this manner, part of the motor unit 20 can be inserted in the inside of the main body casing 14 through the opening section 22 of the main body casing 14 and assembled or part of the motor unit 20 can be taken out from the inside of the main body casing without inclining the motor unit 20 when the main body unit 19 and the motor unit 20 are assembled or separated When the balance weight 23 for keeping balance of the revolving scroll 3 is provided in a section protruding to the main body unit 19 side from the flange 15 of the shaft 6, a projection area viewed from an axial direction between a distal end of the eccentric portion 6A of the shaft 6 and the flange 15 of the motor unit 20 includes the balance weight 23. A diameter of an opening section on the motor unit 20 side is larger than a larger one of a maximum diameter of the eccentric portion 6A of the shaft 6 and a maximum diameter of the balance weight 23.

Figure 5:
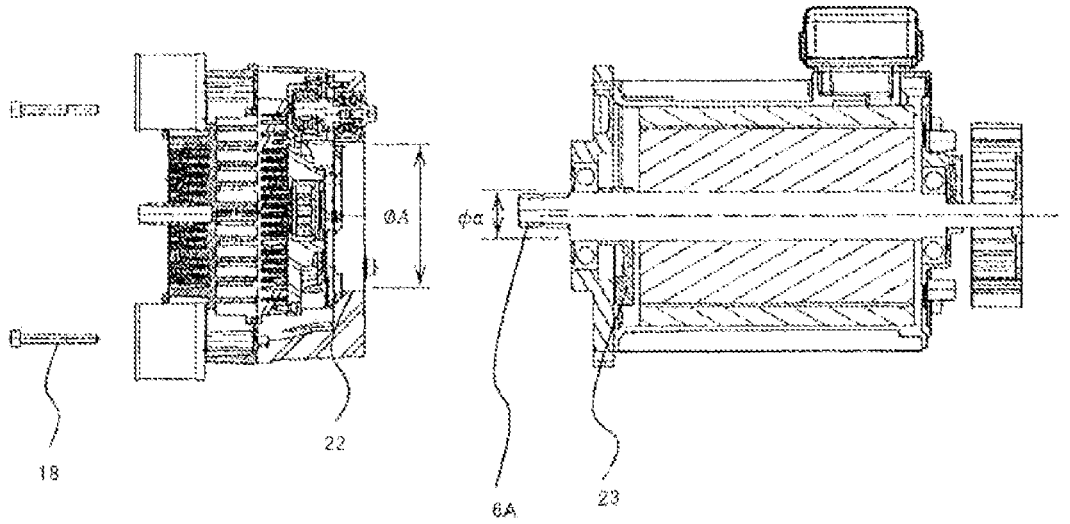
FIG. 5 is a cross-sectional view in a side surface direction showing a state in which the main body unit and the motor unit are separated in a variation of the first embodiment of the present invention.

FIG. 5 shows a variation of the present embodiment. In FIG. 5, the balance weight 23 is arranged in the motor cover 21, that is, a side away from the main body unit 19 farther than the flange 15. In this case, the balance weight 23 does not need to pass through the opening section 22 of the main body casing 14. For this reason, an area of the opening section 22 of the main body casing 14 only needs to be larger than a projection area viewed from an axial direction between a distal end of the eccentric portion 6A and the flange of the motor unit 20. That is, an area of the opening section 22 of the main body casing 14 may be smaller than a cross section viewed from an axial direction of the balance weight 23. By arranging the balance weight 23 in the motor cover 21, the opening section 22 of the main body casing 14 does not need to be made large even when the balance weight 23 is made large. Since the opening section 22 does not need to be made large, the main body casing 14 itself does not need to be formed large, and reduction in size and weight of the entire scroll-type fluid machine 1 can be achieved.

Second Embodiment

Description will be made on a second embodiment of the present invention by using FIG. 6. Configurations which are the same as those in the first embodiment will be attached with the same reference signs and omitted from description. In the present embodiment, description will be made on a fastening position of the main body unit 19 and the motor unit 20.

Figure 6:
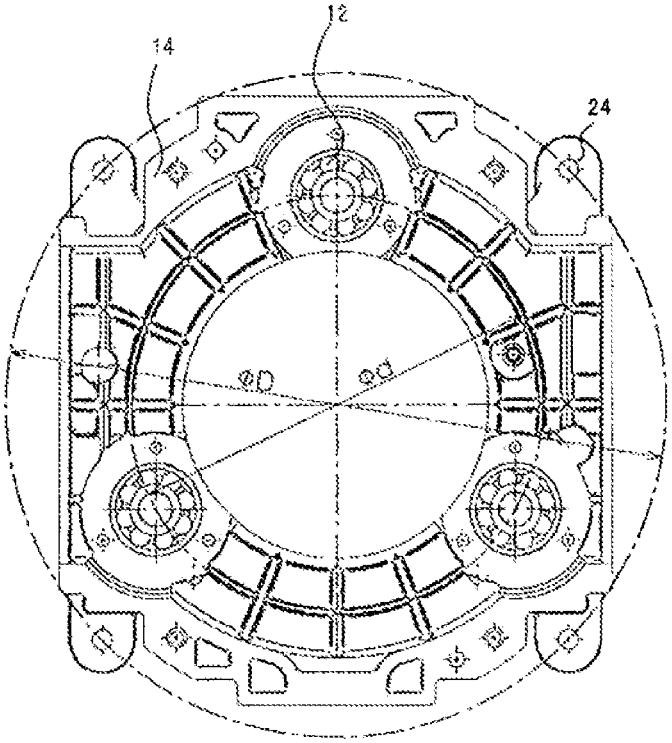
FIG. 6 is a cross-sectional view in an axial direction of the main body unit in a second embodiment of the present invention.

FIG. 6 is a diagram of the main body unit 19 viewed from a back surface side. If the fastening position of the main body unit 19 and the motor unit 20 is on an inner side in a radial direction than an outer peripheral surface of the fixed scroll 2, the fastening position is hidden behind the fixed scroll 2 and hard to observe. Fastening work and separation work are also interfered by the fixed scroll 2. For this reason, maintenance work cannot be performed easily without removing the fixed scroll 2. In the present embodiment, the fastening position of the main body unit 19 and the motor unit 20 (a position of the fastening bearing surface 24) is placed on an outer side in a radial direction than the outer peripheral surface of the fixed scroll 2 on the basis of a center of the shaft 6. In this manner, the fixed scroll 2 does not need to be removed when the main body unit 19 is separated, and the main body unit 19 and the motor unit 20 can be separated in a state where the fixed scroll is attached. In this manner, maintenance can be performed easily.

In addition, in the present embodiment, a distance $\phi D$ from the center of the shaft 6 of the fastening position (the position of the fastening bearing surface 24) is made larger than a distance $\phi d$ from the center of the shaft 6 of the auxiliary crank bearing 13. That is, the fastening position of the main body unit 19 and the motor unit 20 is provided on an outer side in a radial direction than positions of the autorotation preventing mechanisms (the auxiliary crank shaft 11, the revolving-side auxiliary crank bearing 12, and the casing-side auxiliary crank bearing 13).

When the scroll-type fluid machine 1 is operated, the main body unit 19, particularly a compression chamber formed between the fixed scroll 2 and the revolving scroll 3 generates much heat, so that the revolving scroll 3 is thermally expanded. When the revolving scroll 3 is thermally expanded, the auxiliary crank shaft 11 between the revolving scroll 3 and the main body casing is inclined, and a revolving radius of the revolving scroll 3 becomes large. At this time, there is possibility that the wrapping section 2B of the fixed scroll 2 and the wrapping section 3B of the revolving scroll 3 come into contact with each other, and reliability is lowered. On the other hand, if positions of the wrapping sections 2B and 3B are specified so that the wrapping sections 2B and 3B do not come into contact with each other in consideration of deformation caused by thermal expansion of the wrapping section 2B of the fixed scroll 2 and the wrapping section 3B of the revolving scroll 3 in advance, compression performance cannot be secured.

In view of the above, in the present embodiment, the fastening position of the main body unit 19 and the motor unit 20 is arranged on an outer side than the autorotation preventing mechanism. Thermal expansion of the revolving scroll 3 is transmitted to the main body casing 14 through the autorotation preventing mechanism; however, by fastening the main body casing 14 to the motor cover 21 with the fastening bolt 18 on an outer side in the radial direction than the autorotation preventing mechanism, deformation caused by thermal expansion of the main body casing 14 can be restrained. In this manner, a revolving radius of the revolving scroll 3 can be restrained from becoming large, and reliability and compression performance of the revolving scroll 3 can be secured.

All of the embodiments which have been described so far are merely an example of implementing the present invention. The present invention can be implemented by combining the first and second embodiments.

REFERENCE SIGNS LIST

1 Scroll-type fluid machine
2 Fixed scroll
3 Revolving scroll
4 Stator
5 Rotor
6 Shaft
6A Eccentric portion
7 Main bearing
8 Anti-load bearing
9 Boss plate
9A Boss section
10 Revolving bearing
10A Revolving bearing inner ring
10B Revolving bearing roller
10C Revolving bearing outer ring
11 Auxiliary crank shaft
12 Revolving-side auxiliary crank bearing
13 Casing-side auxiliary crank bearing
14 Main body casing
15 Flange
16 End bracket
17 Motor casing
18 Fastening bolt
19 Main body unit
20 Motor unit
21 Motor cover
22 Opening section
23 Balance weight
24 Fastening bearing surface

The invention claimed is:

1. A scroll fluid machine, comprising:

a main body unit configured to compress a fluid; and a motor unit configured to drive the main body unit, wherein the main body unit includes a fixed scroll, a revolving scroll, a main body casing, and an autorotation preventing mechanism configured to be held by the revolving scroll and the main body casing and prevent autorotation of the revolving scroll, the motor unit includes a rotor, a stator configured to rotate the rotor, a shaft configured to rotate integrally with the rotor, a motor cover including a morot casing, the motor cover and the motor casing each surround the rotor and the stator, a flange that overlies the rotor at one end of the motor casing with a first surafce of the flange being fixedly attached to the motor casing, and a main bearing configured to rotatably support the shaft being fixedly attached to the flange so that an external surface of the main bearing has an opposed facing relationship to the rotor across a space formed within the flange and the motor casinng, the autorotation preventing mechanism being attached to the flange at a second surface of the flange opposite the first surface that faces away from the motor casing, the eccentric portion is included at a distal end of the shaft, the main body until and the motor unit are connected via the eccentric portion, the main body casing and the flange are fastened with a fastening member, and positions in an axial direction of the main bearing and at least part of the autorotation preventing mechanism overlap each other when viewed from a radial direction.

2. The scroll fluid machine according to claim 1, wherein the motor cover includes a motor casing and the motor casing and motor cover are positioned on an outer side of the stator in a radial direction of the shaft and the flange is positioned at an end of the motor casing on a main body unit side of the motor casing.

3. The scroll fluid machine according to claim 2, wherein the main body unit and the motor unit are fastened via the flange.

4. The scroll fluid machine according to claim 2, wherein an inner side in a radial direction of the flange protrudes to the main body unit side farther than an outer side in the radial direction.

5. The scroll fluid machine according to claim 2, wherein the flange has a fastening bearing surface fastened to the main body unit with a fastening member, and a position in an axial direction of at least part of the main bearing is closer to a distal end of the eccentric portion than a position in an axial direction of the fastening bearing surface.

6. The scroll fluid machine according to claim 1, wherein a fastening position of the main body unit and the motor unit is on an outer side in a radial direction than an outer peripheral surface of the fixed scroll.

7. The scroll fluid machine according to claim 1, wherein the main body unit includes the autorotation preventing mechanism configured to prevent autorotation of the revolving scroll, a fastening position of the main body unit and the motor unit is at an outer side of the scroll fluid machine in a radial direction farther than the autorotation preventing mechanism.

8. The scroll fluid machine according to claim 1, wherein an opening section is provided on the motor unit side of the main body casing.

9. The scroll fluid machine according to claim 8, wherein the motor unit includes a balance weight on an outer side in a radial direction of the shaft between the flange and rotor, and a projection area viewed from an axial direction between the eccentric portion and the flange of the motor unit is an area including that of the balance weight.

10. The scroll fluid machine according to claim 1, wherein a balance weight is disposed in a space of the motor cover between the flange and the rotor.

11. The scroll fluid machine according to claim 1, comprising a revolving bearing configured to support the eccentric portion, wherein the main body unit includes an outer ring of the revolving bearing, and the motor unit includes an inner ring of the revolving bearing.

12. The scroll fluid machine according to claim 1, wherein the main body unit and the motor unit are removably connected via the eccentric portion.

13. The scroll fluid machine according to claim 1, wherein the fixed scroll and the revolving scroll comprise spiral wrapping sections which are respectively formed on surfaces of panels thereof, the wrapping sections of the fixed scroll and the revolving scroll overlapping each other to constitute a compression chamber.

* * * * *